US005332048A

United States Patent [19]

Underwood et al.

[11] Patent Number: 5,332,048

[45] Date of Patent: Jul. 26, 1994

[54] METHOD AND APPARATUS FOR AUTOMATIC CLOSED LOOP DRILLING SYSTEM

[75] Inventors: Lance D. Underwood, Spring; Harold D. Johnson; Charles H. Dewey, both of Houston, all of Tex.

[73] Assignee: Halliburton Company, Dallas, Tex.

[21] Appl. No.: 965,200

[22] Filed: Oct. 23, 1992

[51] Int. Cl.[5] ..... E21B 7/04

[52] U.S. Cl. ..... 175/26; 175/61; 175/325.3

[58] Field of Search ..... 175/61, 76, 73, 321, 175/325.4, 26

[56] References Cited

U.S. PATENT DOCUMENTS

| | | | |
|---|---|---|---|
| Re. 33,751 | 11/1991 | Geczy et al. | 175/61 |
| 3,051,255 | 8/1962 | Deely | 175/265 |
| 3,092,188 | 6/1963 | Farris et al. | 175/76 |
| 3,123,162 | 3/1964 | Rowley | 175/325 |
| 3,129,776 | 4/1964 | Mann . | |
| 3,305,771 | 2/1967 | Arps | 324/6 |
| 3,309,656 | 3/1967 | Godbey | 340/16 |
| 3,370,657 | 2/1968 | Antle | 175/74 |
| 3,593,810 | 7/1971 | Fields | 175/61 |
| 3,888,319 | 6/1975 | Bourne, Jr. et al. | 175/61 X |
| 3,974,886 | 8/1976 | Blake, Jr. | 175/76 |
| 4,027,301 | 5/1977 | Mayer | 340/183 |
| 4,152,545 | 5/1979 | Gilbreath, Jr. et al. | 179/1.5 R |
| 4,185,704 | 1/1980 | Nixon, Jr. | 175/76 |
| 4,241,796 | 12/1980 | Green et al. | 175/76 X |
| 4,270,619 | 6/1981 | Base | 175/61 |
| 4,351,037 | 9/1982 | Scherbatskoy | 367/85 |
| 4,357,634 | 11/1982 | Chung | 360/40 |
| 4,388,974 | 6/1983 | Jones, Jr. et al. | 175/325 |
| 4,394,881 | 7/1983 | Shirley | 175/76 |
| 4,407,377 | 10/1983 | Russell | 175/325 |
| 4,465,147 | 8/1984 | Feenstra et al. | 175/61 X |

(List continued on next page.)

OTHER PUBLICATIONS

Offshore; *Engineering Drilling/Production*; Jeff Littleton, Nov. 1988; (1 pg.).

D. R. Skinner; Introduction to Petroleum Production; vol. 1, *Reservoir Engineering, Drilling, Well Completions*; (32 p.).

Anadrill and Eastman Teleco; State of the Art in MWD; International MWD Society; Jan. 19, 1993 (28 p.).

Steve Bonner, Trevor Burgess, et al.; *Measurements at the Bit: A New Generation of MWD Tools*; Oilfield Review, Apr./Jul . 1993 (pp. 4–54).

Schlumberger Anadrill; *Anadrill Directional Drilling People, Tools and Technology Put More Within Your Reach*; 1991; (p. 6).

J. S. Williamson; Drilco Div. of Smith Intl. Inc. and A. Lubinski, Consultant; ADC/SPE; *Predicting Bottomhold Assembly Performance* (p. 8).

*Primary Examiner*—Thuy M. Bui
*Assistant Examiner*—Frank S. Tsay
*Attorney, Agent, or Firm*—Michael F. Heim

[57] ABSTRACT

An automatic closed loop drilling system is disclosed for providing automatic directional drilling capabilities in a bottomhole assembly. The drilling system includes at least one adjustable stabilizer that varies in response to formational and drilling conditions encountered downhole. A microcontroller is preprogrammed with a desired range of formation characteristics or with a desired inclination or target area. The microcontroller compares actual sensed data with the desired data and adjusts the position of the stabilizer blades to vary the direction of drilling.

26 Claims, 6 Drawing Sheets

U.S. PATENT DOCUMENTS

| | | | |
|---|---|---|---|
| 4,491,187 | 1/1985 | Russell | 175/325 |
| 4,515,225 | 5/1985 | Dailey | 175/40 |
| 4,572,305 | 2/1986 | Swietlik | 175/325 |
| 4,635,736 | 1/1987 | Shirley | 175/76 |
| 4,638,873 | 1/1987 | Welhorn | 175/76 X |
| 4,655,289 | 4/1987 | Schoeffler | 166/320 |
| 4,683,956 | 8/1987 | Russell | 166/383 |
| 4,763,258 | 8/1988 | Engelder | 364/422 |
| 4,787,093 | 11/1988 | Rorden | 375/23 |
| 4,807,708 | 2/1989 | Forrest et al. | 175/45 |
| 4,821,817 | 4/1989 | Cendre et al. | 175/269 |
| 4,844,178 | 7/1989 | Cendre et al. | 175/73 |
| 4,848,488 | 7/1989 | Cendre et al. | 175/61 |
| 4,848,490 | 7/1989 | Anderson | 175/323 |
| 4,854,403 | 8/1989 | Ostertag et al. | 175/325 |
| 4,905,774 | 3/1990 | Wittrisch | 175/26 |
| 4,908,804 | 3/1990 | Rorden | 367/81 |
| 4,947,944 | 8/1990 | Coltman et al. | 175/73 |
| 4,951,760 | 8/1990 | Cendre et al. | 175/269 |
| 5,038,872 | 8/1991 | Shirley | 175/76 |
| 5,050,692 | 9/1991 | Beimgraben | 175/61 |
| 5,065,825 | 11/1991 | Bardin et al. | 175/38 |
| 5,070,950 | 12/1991 | Cendre et al. | 175/74 |
| 5,139,094 | 8/1992 | Prevedel et al. | 175/61 |
| 5,160,925 | 11/1992 | Dailey et al. | 340/853.3 |
| 5,181,576 | 1/1993 | Askew et al. | 175/61 |
| 5,186,264 | 2/1993 | du Chaffaut | 175/76 X |
| 5,224,558 | 7/1993 | Lee | 175/325.4 |

METHOD AND APPARATUS FOR AUTOMATIC CLOSED LOOP DRILLING SYSTEM

BACKGROUND OF THE INVENTION

I. Field of the Invention

The present invention relates generally to a steerable system for controlling borehole deviation with respect to the vertical axis by varying the angle of such deviation without removing (tripping) the system from the borehole, and more particularly to a directional drilling apparatus that is remotely adjustable or variable during operation for affecting deviation control.

II. Description of the Prior Art

The technology developed with respect to drilling boreholes in the earth has long encompassed the use of various techniques and tools to control the deviation of boreholes during the drilling operation. One such system is shown in U.S. Pat. No. 33,751, and is commonly referred to as a steerable system. By definition, a steerable system is one that controls borehole deviation without being required to be withdrawn from the borehole during the drilling operation.

The typical steerable system today comprises a downhole motor having a bent housing, a fixed diameter near bit stabilizer on the lower end of the motor housing, a second fixed diameter stabilizer above the motor housing and an MWD (measurement-while-drilling) system above that. A lead collar of about three to ten feet is sometimes run between the motor and the second stabilizer. Such a system is typically capable of building, dropping or turning about three to eight degrees per 100 feet when sliding, i.e. just the motor output shaft is rotating the drill bit while the drill string remains rotationally stationary. When rotating, i.e. both the motor and the drill string are rotating to drive the bit, the goal is usually for the system to simply hold angle (zero build rate), but variations in hole conditions, operating parameters, wear on the assembly, etc. usually cause a slight build or drop. This variation from the planned path may be as much as ±one degree per 100 feet. When this occurs, two options are available. The first option is to make periodic corrections by sliding the system part of the time. The second option is to trip the assembly and change the lead collar length or, less frequently, the diameter of the second stabilizer to fine tune the rotating mode build rate.

One potential problem with the first option is that when sliding, sharp angle changes referred to as doglegs and ledges may be produced, which increase torque and drag on the drill string, thereby reducing drilling efficiencies and capabilities. Moreover, the rate of penetration for the system is lower during the sliding mode. The problem with the second option is the costly time it takes to trip. In addition, the conditions which prevented the assembly from holding angle may change again, thus requiring additional sliding or another trip.

The drawbacks to the steerable system make it desirable to be able to make less drastic directional changes and to accomplish this while rotating. Such corrections can readily be made by providing a stabilizer in the assembly that is capable of adjusting its diameter or the position of its blades during operation. As one skilled in the art will understood, changing the effective diameter of a stabilizer changes the angle of the drill string, in the vertical plane, with respect to the hole, thereby changing the direction that the bit drills.

One such adjustable stabilizer known as the Andergage, is commercially available and is described in U.S. Pat. No. 4,848,490. This stabilizer adjusts a half-inch diametrically, and when run above a steerable motor, is capable of inclination corrections on the order of ±one-half a degree per 100 feet, when rotating. This tool is activated by applying weight to the assembly and is locked into position by the flow of the drilling fluid. This means of communication and actuation essentially limits the number of positions to two, i.e. extended and retracted. This tool has an additional operational disadvantage in that it must be reset each time a connection is made during drilling.

To verify that actuation has occurred, a 200 psi pressure drop is created when the stabilizer is extended. One problem with this is that it robs the bit of hydraulic horsepower. Another problem is that downhole conditions may make it difficult to detect the 200 psi increase. Still another problem is that if a third position were required, an additional pressure drop would necessarily be imposed to monitor the third position. This would either severely starve the bit or add significantly to the surface pressure requirements.

Another limitation of the Andergage is that its one-half inch range of adjustment may be insufficient to compensate for the cumulative variations in drilling conditions mentioned above. As a result, it may be necessary to continue to operate in the sliding mode.

The Andergage is currently being run as a near-bit stabilizer in rotary-only applications, and as a second stabilizer (above the bent motor housing) in a steerable system. However, the operational disadvantages mentioned above have prevented its widespread use.

Another adjustable or variable stabilizer, the Varistab, has seen very limited commercial use. This stabilizer is covered by the following U.S. Pat. Nos.: 4,821,817; 4,844,178; 4,848,488; 4,951,760; 5,065,825; and 5,070,950. This stabilizer may have more than two positions, but the construction of the tool dictates that it must index through these positions in order. The gauge of the stabilizer remains in a given position, regardless of flow status, until an actuation cycle drives the blades of the stabilizer to the next position. The blades are driven outwardly by a ramped mandrel, and no external force in any direction can force the blade to retract. This is an operational disadvantage. If the stabilizer were stuck in a tight hole and were in the middle position, it would be difficult to advance it through the largest extended position to return to the smallest. Moreover, no amount of pipe movement would assist in driving the blades back.

To actuate the blade mechanism, flow must be increased beyond a given threshold. This means that in the remainder of the time, the drilling flow rate must be below the threshold. Since bit hydraulic horsepower is a third power function of flow rate, this communication-actuation method severely reduces the hydraulic horsepower available to the bit.

The source of power for indexing the blades is the increased internal pressure drop which occurs when the flow threshold is exceeded. It is this actuation method that dictates that the blades remain in position even after flow is reduced. The use of an internal pressure drop to hold blades in position (as opposed to driving them there and leaving them locked in position) would require a constant pressure restriction, which would even be more undesirable.

A pressure spike, detectable at the surface, is generated when activated, but this is only an indication that activation has occurred. The pressure spike does not uniquely identify the position which has been reached. The driller, therefore, is required to keep track of pressure spikes in order to determine the position of the stabilizer blades. However, complications arise because conditions such as motor stalling, jets plugging, and cuttings building up in the annulus, all can create pressure spikes which may give false indications. To date, the Varistab has had minimal commercial success due to its operational limitations.

With respect to the tool disclosed in U.S. Pat. No. 5,065,825, the construction taught in this patent would allow communication and activation at lower flow rate thresholds. However, there is no procedure to permit the unique identification of the blade position. Also, measurement of threshold flow rates through the use of a differential pressure transducer can be inaccurate due to partial blockage or due to variations in drilling fluid density.

Another adjustable stabilizer recently commercialized is shown in U.S. Pat. No. 4,572,305. It has four straight blades that extend radially three or four positions and is set by weight and locked into position by flow. The amount of weight on bit before flow initiates will dictate blade position. The problem with this configuration is that in directional wells, it can be very difficult to determine true weight-on-bit and it would be hard to get this tool to go to the right position with setting increments of only a few thousand pounds per position.

Other patents pertaining to adjustable stabilizers or downhole tool control systems are listed as follows: U.S. Pat. No. 3,051,255; 3,123,162; 3,370,657; 3,974,886; 4,270,619; 4,407,377; 4,491,187; 4,572,305; 4,655,289; 4,683,956; 4,763,258; 4,807,708; 4,848,490; 4,854,403; and 4,947,944.

The failure of adjustable stabilizers to have a greater impact on directional drilling can generally be attributed to either lack of ruggedness, lack of sufficient change in diameter, inability to positively identify actual diameter, or setting procedures which interfere with the normal drilling process. The above methods accomplish control of the inclination of a well being drilled. Other inventions may control the azimuth (i.e. direction in the horizontal plane) of a well. Examples of patents relating to azimuth control include the following: U.S. Pat. No. 3,092,188; 3,593,810; 4,394,881; 4,635,736; and 5,038,872.

SUMMARY OF THE INVENTION

The present invention obviates the above-mentioned shortcomings in the prior art by providing an adjustable or variable stabilizer system having the ability to actuate the blades of the stabilizer to multiple positions and to communicate the status of these positions back to the surface, without significantly interfering with the drilling process.

The adjustable stabilizer, in accordance with the present invention, comprises two basic sections, the lower power section and the upper control section. The power section includes a piston for expanding the diameter of the stabilizer blades. The piston is actuated by the pressure differential between the inside and the outside of the tool. A positioning mechanism in the upper body serves to controllably limit the axial travel of a flow tube in the lower body, thereby controlling the radial extension of the blades. The control section comprises novel structure for measuring and verifying the location of the positioning mechanism. The control section further comprises an electronic control unit for receiving signals from which position commands may be derived. Finally, a microprocessor or microcontroller preferably is provided for encoding the measured position into time/pressure signals for transmission to the surface whereby these signals identify the position.

The above noted objects and advantages of the present invention will be more fully understood upon a study of the following description in conjunction with the detailed drawings.

BRIEF DESCRIPTION OF THE DRAWINGS

The following drawings will be referred to in the following discussion of the preferred embodiment.

DESCRIPTION OF THE PREFERRED EMBODIMENTS AND BEST MODE FOR CARRYING OUT THE INVENTION

Figure 1A:
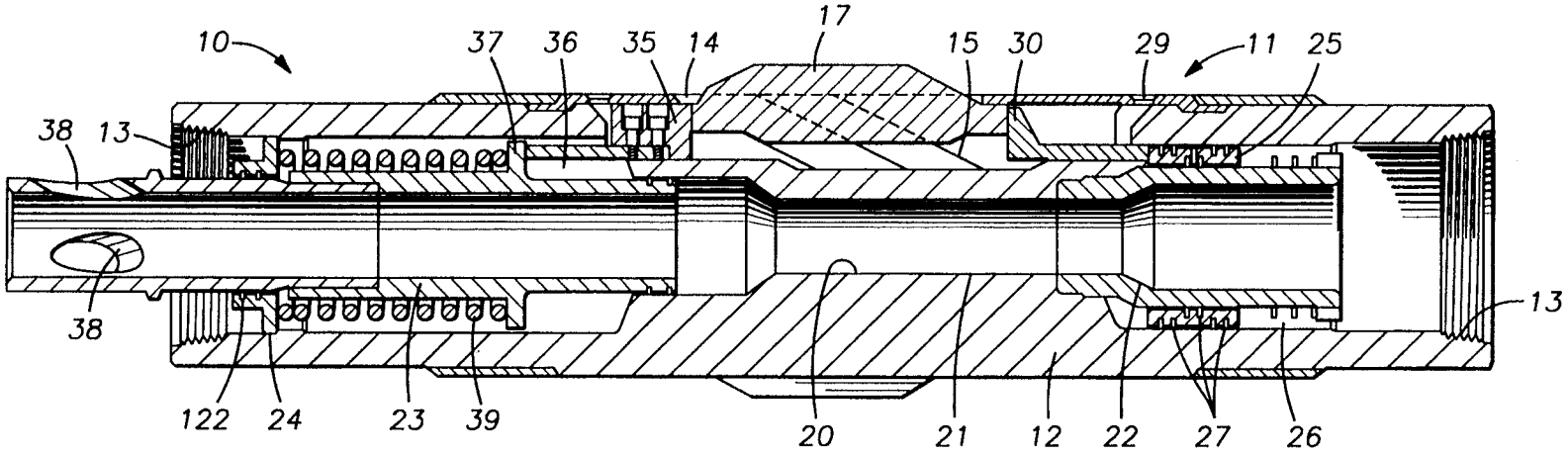
FIG. 1A is a sectional view of the lower section of the adjustable stabilizer according to the present invention.
Figure 1B:
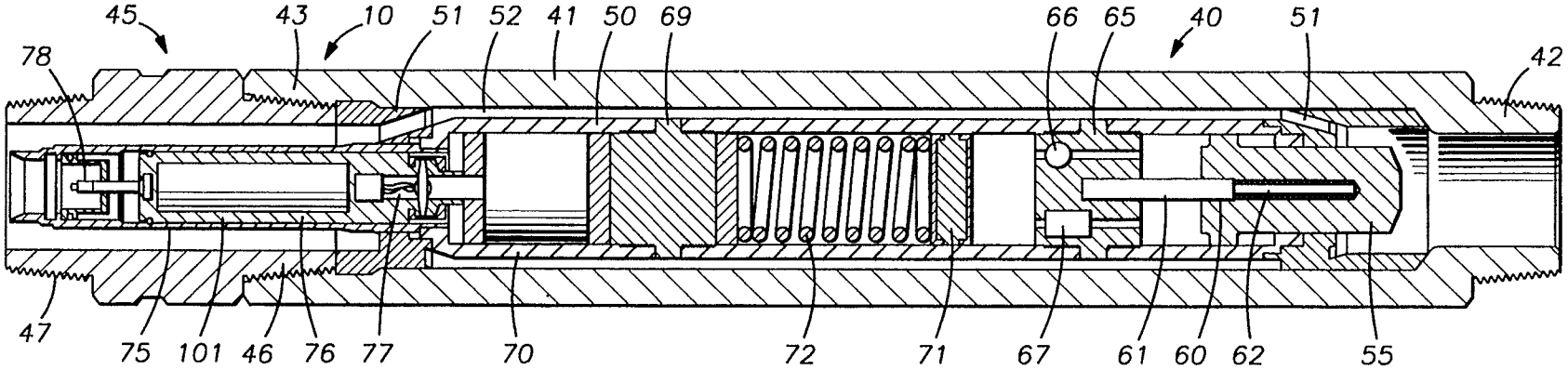
FIG. 1B is a sectional view of the upper section of the adjustable stabilizer of the present invention.

Referring now to the drawings, FIGS. 1A and 1B illustrate an adjustable stabilizer, generally indicated by arrow 10, having a power section 11 and a control section 40. The power section 11 comprises an outer tubular body 12 having an outer diameter approximately equal to the diameter of the drill collars and other components located on the lower drill string forming the bottom hole assembly. The tubular body 12 is hollow and includes female threaded connections 13 located at its ends for connection to the pin connections of the other bottom hole assembly components.

Figure 2:
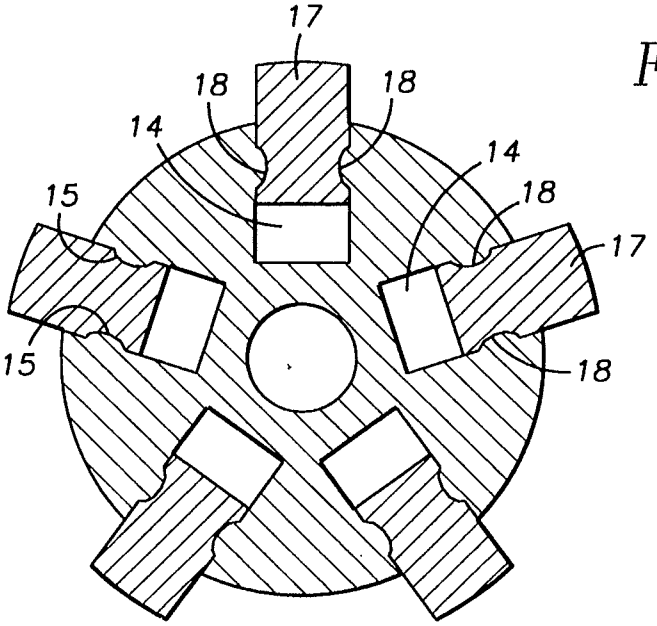
FIG. 2 is a sectional view taken along lines 2—2 of FIG. 1A.
Figure 4:
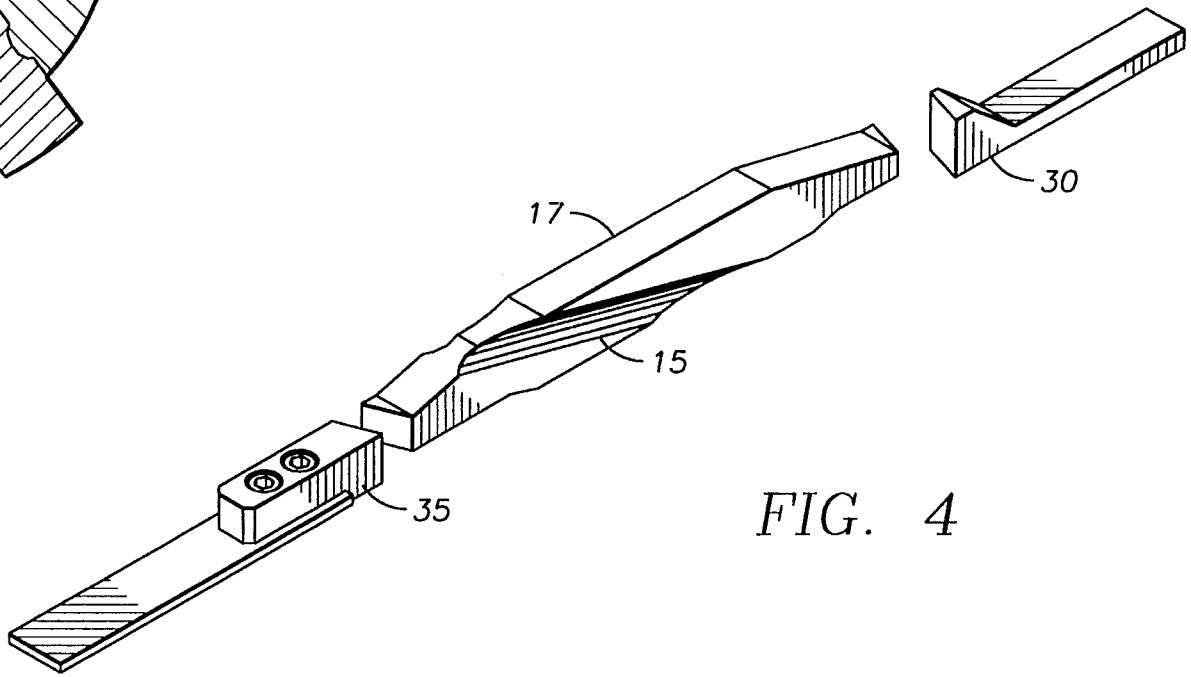
FIG. 4 is an elevational view showing a stabilizer blade and the push and follower rod assemblies utilized in the embodiment shown in FIG. 1A.
Figure 3:
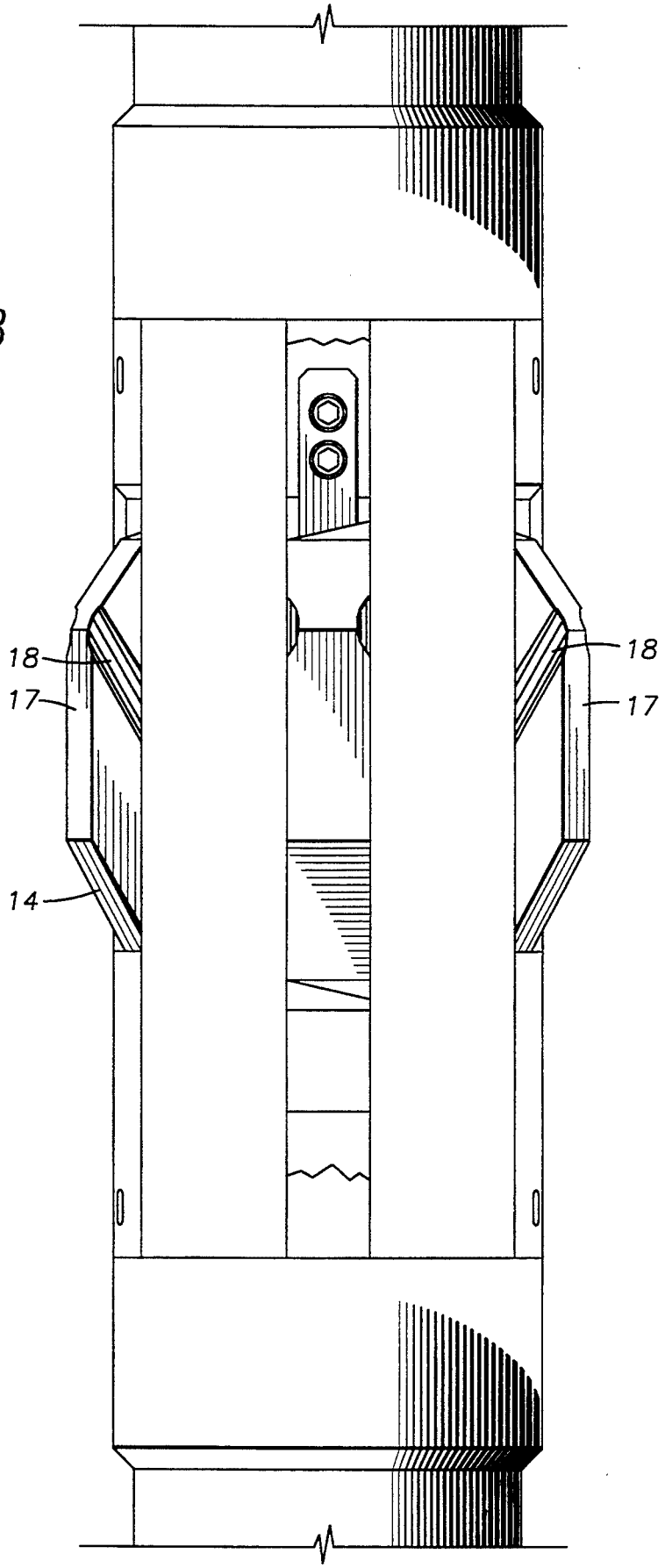
FIG. 3 is an elevational view of the lower section taken along lines 3—3 of FIG. 1A.

The middle section of the tubular body 12 has five axial blade slots 14 radially extending through the outer body and equally spaced around the circumference thereof. Although five slots are shown, any number of blades could be utilized. Each slot 14 further includes a pair of angled blade tracks 15 or guides which are formed in the body 12. These slots could also be formed into separate plates to be removably fitted into the body 12. The function of these plates would be to keep the wear localized in the guides and not on the body. A plurality of blades 17 are positioned within the slots 14 with each blade 17 having a pair of slots 18 formed on both sides thereof for receiving the projected blades tracks 15. It should be noted that the tracks 15 and the corresponding blade slots 18 are slanted to cause the blades 17 to move axially upward as they move radially outward. These features are more clearly illustrated in FIGS. 2, 3 and 4.

Referring back to FIG. 1A, a multi-sectioned flow tube 20 extends through the interior of the outer tubular body 12. The central portion 21 of the flow tube 20 is integrally formed with the interior of the tubular body 12. The lower end of the flow tube 20 comprises a tube section 22 integrally mounted to the central portion 21. The upper end of the flow tube 20 comprises a two piece tube section 23 with the lower end thereof being slidingly supported within the central portion 21. The upper end of the tube section 23 is slidingly supported within a spacer rib or bushing 24. Appropriate seals 122 are provided to prevent the passage of drilling fluid flow around the tube section 23.

The tube section 22 axially supports an annular drive piston 25. The outer diameter of the piston 25 slidingly engages an interior cylindrical portion 26 of the body 12. The inner diameter of the piston 25 slidingly engages the tube section 22. The piston 25 is responsive to the pressure differential between the flow of the drilling fluid down through the interior of the stabilizer 10 and the flow of drilling fluid passing up the annulus formed by the borehole and the outside of the tube 12. Ports 29 are located on the body 12 to provide fluid communication between the borehole annulus and the interior of the body 12. Seals 27 are provided to prevent drilling fluid flow upwardly past the piston 25.

The cylindrical chamber 26 and the blade slot 14 provide a space for receiving push rods 30. The lower end of each push rod 30 abuts against the piston 25. The upper end of each push rod 30 is enlarged to abut against the lower side of a blade 17. The lower end faces of the blades 17 are angled to match an angled face of the push rod upper end to force the blades 14 against one side of the pocket to maintain contact therewith (see FIG. 4). This prevents drilled cuttings from packing between the blades and pockets and causing vibration and abrasive or fretting type wear.

The upper sides of the blades 17 are adapted to abut against the enlarged lower ends of follower rods 35. The abutting portions are bevelled in the same direction as the lower blade abutting connections for the purpose described above. The upper end of each follower rod 35 extends into an interior chamber 36 and is adapted to abut against an annular projection 37 formed on the tube section 23. A return spring 39 is also located within chamber 36 and is adapted to abut against the upper side of the projection 37 and the lower side of the bushing 24.

The upper end of the flow tube 23 further includes a plurality of ports 38 to enable drilling fluid to pass downwardly therethrough.

FIG. 1B further illustrates the control section 40 of the adjustable stabilizer 10. The control section 40 comprises an outer tubular body 41 having an outer diameter approximately equal to the diameter of body 12. The lower end of the body 41 includes a pin 42 which is adapted to be threadedly connected to the upper box connection 13 of the body 12. The upper end of the body 41 comprises a box section 43.

The control section 40 further includes a connector sub 45 having pins 46 and 47 formed at its ends. The lower pin 46 is adapted to be threadedly attached to the box 43 while the upper pin 47 is adapted to be threadedly connected to another component of the drill string or bottom assembly which may be a commercial MWD system.

The tubular body 41 forms an outer envelope for an interior tubular body 50. The body 50 is concentrically supported within the tubular body 41 at its ends by support rings 51. The support rings 51 are ported to allow drilling fluid flow to pass into the annulus 52 formed between the two bodies. The lower end of tubular body 50 slidingly supports a positioning piston 55, the lower end of which extends out of the body 50 and is adapted to engage the upper end of the flow tube 23.

The interior of the piston 55 is hollow in order to receive an axial position sensor 60. The position sensor 60 comprises two telescoping members 61 and 62. The lower member 62 is connected to the piston 55 and is further adapted to travel within the first member 61. The amount of such travel is electronically sensed in the conventional manner. The position sensor 60 is preferably a conventional linear potentiometer and can be purchased from a company such as Subminiature Instruments Corporation, 950 West Kershaw, Ogden, Utah 84401. The upper member 61 is attached to a bulkhead 65 which is fixed within the tubular body 50.

The bulkhead 65 has a solenoid operated valve and passage 66 extending therethrough. In addition, the bulkhead 65 further includes a pressure switch and passage 67.

A conduit tube (not shown) is attached at its lower end to the bulkhead 65 and at its upper end to and through a second bulkhead 69 to provide electrical communication for the position sensor 60, the solenoid valve 66, and the pressure switch 67, to a battery pack 70 located above the second bulkhead 69. The batteries preferably are high temperature lithium batteries such as those supplied by Battery Engineering, Inc., of Hyde Park, Mass.

A compensating piston 71 is slidingly positioned within the body 50 between the two bulkheads. A spring 72 is located between the piston 71 and the second bulkhead 69, and the chamber containing the spring is vented to allow the entry of drilling fluid.

The connector sub 45 functions as an envelope for a tube 75 which houses a microprocessor 101 and power regulator 76. The microprocessor 101 preferably comprises a Motorola M68HC11, and the power regulator 76 may be supplied by Quantum Solutions, Inc., of Santa Clara, Calif. Electrical connections 77 are provided to interconnect the power regulator 76 to the battery pack 70.

Figure 6:
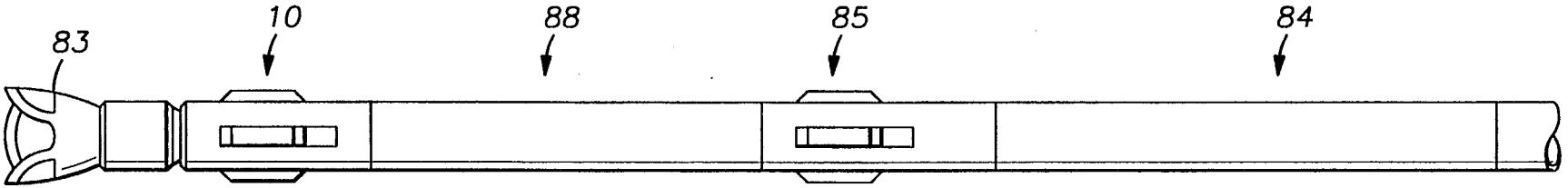
FIG. 6 is an elevational view of a second embodiment of a bottom hole assembly utilizing the adjustable stabilizer of the present invention.

Finally, a data line connector 78 is provided with the tube 75 for interconnecting the microprocessor 101 with the measurement-while-drilling (MWD) sub 84 located above the stabilizer 10 (FIG. 6).

In operation, the stabilizer 10 functions to have its blades 17 extend or retract to a number of positions on command. The power source for moving the blades 17 comprises the piston 25, which is responsive to the pressure differential existing between the inside and the outside of the tool. The pressure differential is due to the flow of drilling fluid through the bit nozzles and downhole motor, and is not generated by any restriction in the stabilizer itself. This pressure differential drives the piston 25 upwardly, driving the push rods 30 which in turn drive the blades 17. Since the blades 17 are on angled tracks 15, they expand radially as they travel axially. The follower rods 35 travel with the blades 17 and drive the flow tube 23 axially.

The axial movement of the flow tube 23 is limited by the positioning piston 55 located in the control section 40. Limiting the axial travel of the flow tube 23 limits the radial extension of the blades 17.

As mentioned previously, the end faces of the blades 17 (and corresponding push rod and follower rod faces) are angled to force the blades to maintain contact with one side of the blade pocket (in the direction of the rotationally applied load), thereby preventing drilled cuttings from packing between the blade and pocket and causing increased wear.

The blade slots 14 communicate with the body cavity 12 only at the ends of each slot, leaving a tube (see FIG. 2), integral to the body and to the side walls of each slot, to transmit flow through the pocket area.

In the control section, there are three basic components: hydraulics, electronics, and a mechanical spring. In the hydraulic section, there are basically two reservoirs, defined by the positioning piston 55, the bulkhead 65, and the compensating piston 71. The spring 72 exerts a force on the compensating piston 71 to influence hydraulic oil to travel through the bulkhead passage and extend the positioning system. The solenoid operated valve 66 in the bulkhead 65 prevents the oil from transferring unless the valve is open. When the valve 66 is triggered open, the positioning piston 55 will extend when flow of drilling mud is off, i.e. no force is being exerted on the positioning piston 55 by the flow tube 23. To retract the piston 55, the valve 66 is held open when drilling mud is flowing. The annular piston 25 in the lower power section 11 then actuates and the flow tube 22 forces the positioning piston 55 to retract.

The position sensor 60 measures the extension of the positioning piston 55. The microcontroller 101 monitors this sensor and closes the solenoid valve 66 when the desired position has been reached. The differential pressure switch 67 in the bulkhead 65 verifies that the flow tube 23 has made contact with the positioning piston 55. The forces exerted on the piston 55 causes a pressure increase on that side of the bulkhead.

The spring preload on the compensating piston 71 insures that the pressure in the hydraulic section is equal to or greater than downhole pressure to minimize the possibility of mud intrusion into the hydraulic system.

The remainder of the electronics (battery, microprocessor and power supply) are packaged in a pressure barrel to isolate them from downhole pressure. A conventional single pin wet-stab connector 78 is the data line communication between the stabilizer and MWD (measurement while drilling) system. The location of positioning piston 55 is communicated to the MWD and encoded into time/pressure signals for transmission to the surface.

Figure 5:
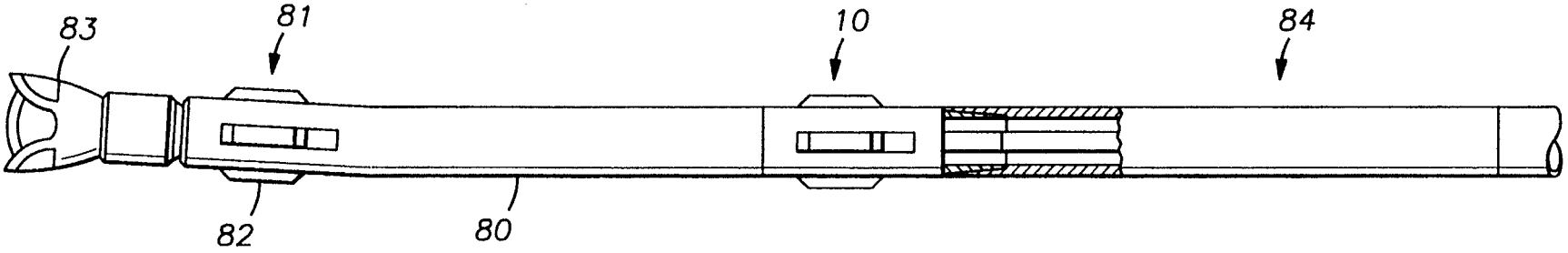
FIG. 5 is an elevational view of one embodiment of a bottom hole assembly utilizing the adjustable stabilizer.

FIG. 5 illustrates the adjustable stabilizer 10 in a steerable bottom hole assembly that operates in the sliding and rotational mode. This assembly preferably includes a downhole motor 80 having at least one bend and a stabilization point 81 located thereon. Although a conventional concentric stabilizer 82 is shown, pads, eccentric stabilizers, enlarged sleeves or enlarged motor housing may also be utilized as the stabilization point. The adjustable stabilizer 10, substantially as shown in FIGS. 1 through 4, preferably is used as the second stabilization point for fine tuning inclination while rotating. Rapid inclination and/or azimuth changes are still achieved by sliding the bent housing motor. The bottom hole assembly also utilizes a drill bit 83 located at the bottom end thereof and a MWD unit 84 located above the adjustable stabilizer.

FIG. 6 illustrates a second bottom hole assembly in which the adjustable stabilizer 10, as disclosed herein, preferably is used as the first stabilization point directly above the bit 83. In this configuration, a bent steerable motor is not used. This system preferably is run in the rotary mode. The second stabilizer 85 also may be an adjustable stabilizer or a conventional fixed stabilizer may be used. Alternatively, an azimuth control device also can be utilized as the second stabilization point, or between the first and second stabilization points. An example of such an azimuth control device is shown in U.S. Pat. No. 3,092,188, the teachings of which are incorporated by reference herein.

In the system shown in FIG. 6, a drill collar is used to space out the first and second stabilizers. The drill collar may contain formation evaluation sensors 88 such as gamma and/or resistivity. An MWD unit 84 preferably is located above the second stabilization point.

Figure 7:
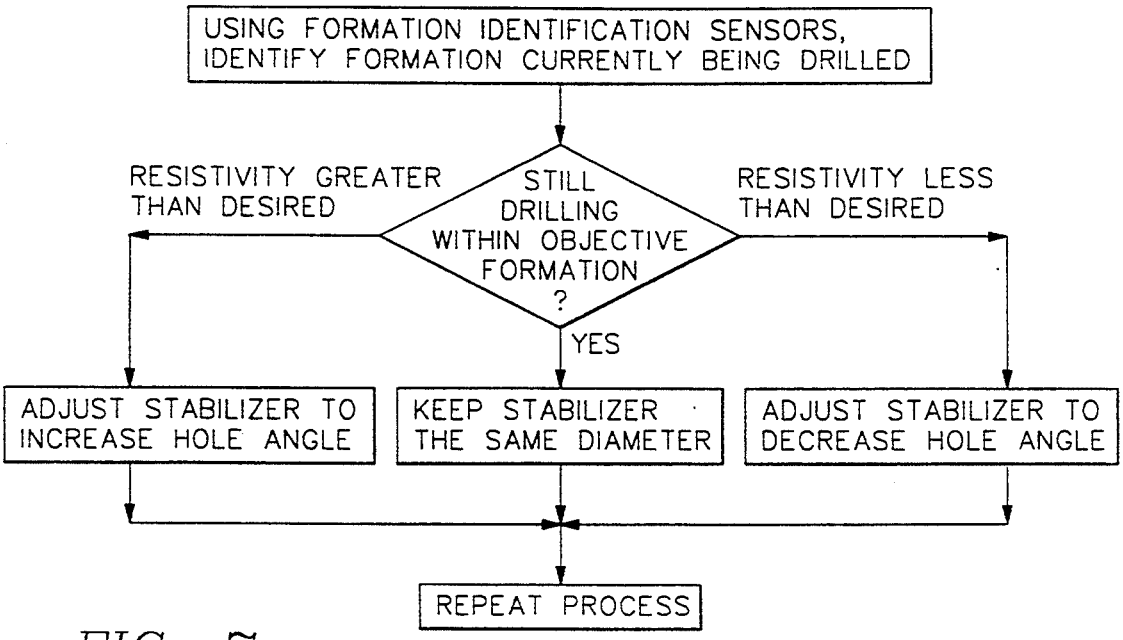
FIG. 7 is a flow chart illustrating operation of an automatic closed loop drilling system for drilling in a desired formation using the adjustable stabilizer of the present invention.

In the systems shown in FIGS. 5 and 6, geological formation measurements may be used as the basis for stabilizer adjustment decisions. These decisions may be made at the surface and communicated to the tool through telemetry, or may be made downhole in a closed loop system, using a method such as that shown in FIG. 7. Alternatively, surface commands may be used interactively with a closed loop system. For example, surface commands setting a predetermined range of formation characteristics (such as resistivity ranges or the like) may be transmitted to the microcontroller, once a particular formation is entered. The actual predetermined range of characteristics may be transmitted from the surface, or various predetermined ranges of characteristics may be preprogrammed in the microcontroller and selected by a command from the surface. Once the range is determined, the microcontroller then implements the automatic closed loop system as shown in FIG. 7 to stay within the desired formation.

By using geological formation identification sensors, it can be determined if the drilling assembly is still within the objective formation. If the assembly has exited the desired or objective formation, the stabilizer diameter can be adjusted to allow the assembly to reenter that formation. A similar geological steering method is generally disclosed in U.S. Pat. No. 4,905,774, in which directional steering in response to geological inputs is accomplished with a turbine and controllable bent member in some undisclosed fashion. As one skilled in the an will immediately realize, the use of the adjustable blade stabilizer, as disclosed herein, makes it possible to achieve directional control in a downhole assembly, without the necessity of surface commands and without the directional control being accomplished through the use of a bent member.

The following describes the operation of the stabilizer control system. Referring still to FIGS. 5 and 6, the MWD system customarily has a flow switch (not shown) which currently informs the MWD system of the flow status of the drilling fluid (on/off) and triggers the powering up of sensors. Timed flow sequences are also used to communicate various commands from the surface to the MWD system. These commands may include changing various parameters such as survey data sent, power usage levels, and so an. The current MWD system is customarily programmed so that a single "short cycle" of the pump (flow on for less than 30 seconds) tells the MWD to "sleep", or to not acquire a survey.

The stabilizer as disclosed herein preferably is programmed to look for two consecutive "short cycles" as the signal that a stabilizer repositioning command is about to be sent. The duration of flow after the two short cycles will communicate the positioning command. For example, if the stabilizer is programmed for 30 seconds per position, two short cycles followed by flow which terminates between 90 and 120 seconds would mean position three.

The relationship between the sequence of states and the flow timing may be illustrated by the following diagram:

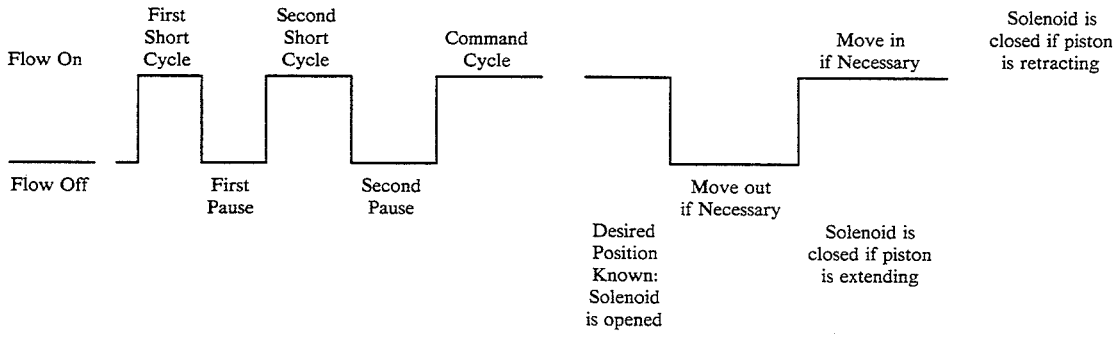

Timing Parameters

The timing parameters preferably are programmable and are specified in seconds. The settings are stored in non-volatile memory and are retained when module power is removed.

| | | |
|---|---|---|
| TSig | Signal Time | The maximum time for a "short" flow cycle. |
| TDly. | Delay Time | The maximum time between "short" flow cycles. |
| TZro | Zero Time | Flow time corresponding to position 0. |
| TCmd | Command Time | Time increment per position increment. |

A command cycle preferably comprises two parts. In order to be considered a valid command, the flow must remain on for at least TZro seconds. This corresponds to position zero. Every increment of length TOnal that the flow remains on after TZro indicates one increment in commanded position. (Currently, if the flow remains on more than 256 seconds during the command cycle, the command will be aborted. This maximum time may be increased, if necessary.)

Following the command cycle, the desired position is known. Referring to FIGS. 1 through 4, if the position is increasing the solenoid valve 66 is activated to move positioning piston 55, thereby allowing decreased movement of the annular drive piston 25. The positioning piston 55 is locked when the new position is reached. If the position is decreasing, the solenoid valve 66 is activated before mud flow begins again, but is not deactivated until the flow tube 23 drives the positioning piston 55 to retract to the desired position. When flow returns, the positioning piston 55 is forced back to the new position and locked. Thus after the repositioning command is received, the positioning piston 55 is set while flow is off. When flow resumes, the blades 17 expand to the new position by the movement of drive piston 25.

When making a drill string connection, the blades 17 will collapse because no differential pressure exists when flow is off and thus drive piston 25 is at rest. If no repositioning command has been sent, the positioning piston 55 will not move, and the blades 17 will return to their previous position when flow resumes.

Referring now to FIGS. 5 and 6, when flow of the drilling fluid stops, the MWD system 84 takes a directional survey, which preferably includes the measured values of the azimuth (i.e. direction in the horizontal plane with respect to magnetic north) and inclination (i.e. angle in the vertical plane with respect to vertical) of the wellbore. The measured survey values preferably are encoded into a combinatorial format such as that disclosed in U.S. Pat. Nos. 4,787,093 and 4,908,804, the teachings of which are incorporated by reference herein. An example of such a combinational MWD pulse is shown in FIG. 9(C).

Figure 9A:
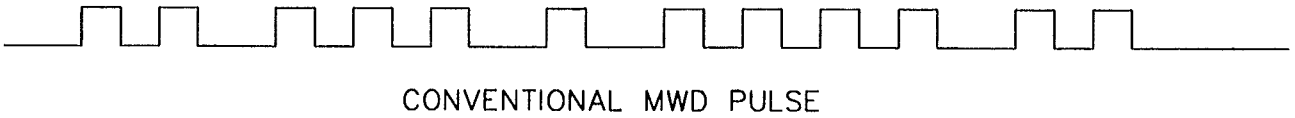
FIG. 9A–C is a drawing illustrating the combined time/pulse encoding technique used in the preferred embodiment of the present invention to encode stabilizer position data.
Figure 9B:
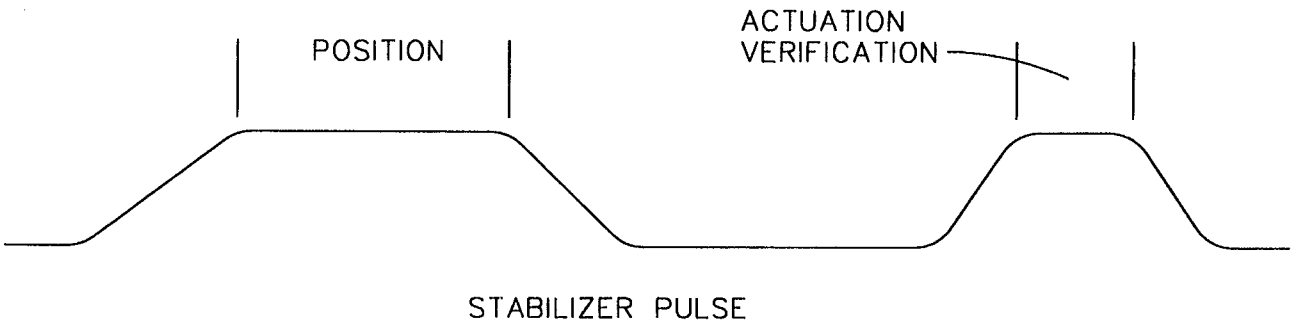
Figure 9C:
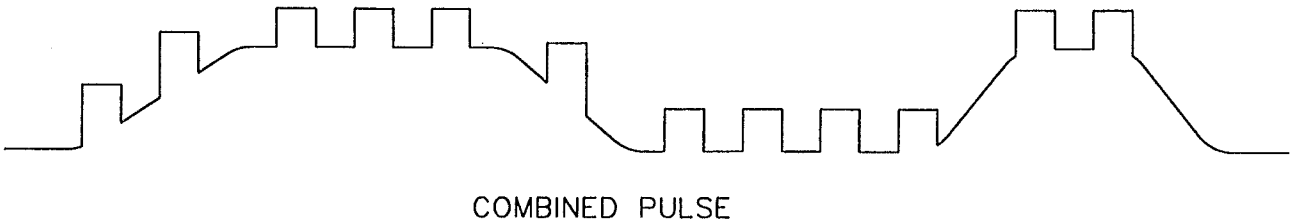

Referring now to FIG. 9(A)–(C), when flow resumes, a pulser (not shown) such as that disclosed in U.S. Pat. No. 4,515,225 (incorporated by reference herein), transmits the survey through mud pulse telemetry by periodically restricting flow in timed sequences, dictated by the combinatorial encoding scheme. The timed pressure pulses are detected at the surface by a pressure transducer and decoded by a computer. The practice of varying the timing of pressure pulses, as opposed to varying only the magnitude of pressure restriction(s) as is done conventionally in the stabilizer systems cited in prior art, allows a significantly larger quantity of information to be transmitted without imposing excessive pressure losses in the circulating system. Thus, as shown in FIG. 9(A)–(C), the stabilizer pulse may be combined or superimposed with a conventional MWD pulse to permit the position of the stabilizer blades to be encoded and transmitted along with the directional survey.

Figure 8:
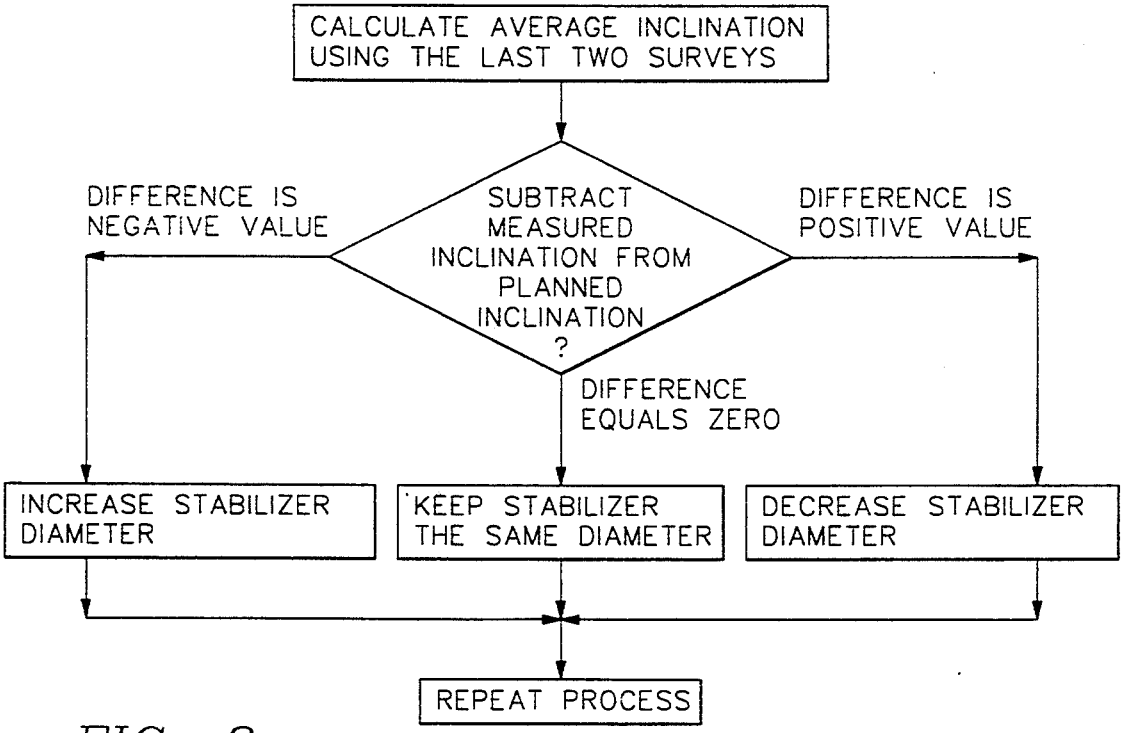
FIG. 8 is a flow chart illustrating the operation of an automatic closed loop drilling system for drilling in a desired direction using the adjustable stabilizer of the present invention.

Directional survey measurements may be used as the basis for stabilizer adjustment decisions. Those decisions may be made at the surface and communicated to the tool through telemetry, or may be made downhole in a closed loop system, using a method such as that shown in FIG. 8. Alternatively, surface commands may be used interactively in a manner similar to that disclosed with respect to the method of FIG. 7. By comparing the measured inclination to the planned inclination, the stabilizer diameter may be increased, decreased, or remain the same. As the hole is deepened and subsequent surveys are taken, the process is repeated. In addition, the present invention also can be used with geological or directional data taken near the bit and transmitted through an EM short hop transmission, as disclosed in commonly assigned U.S. Pat. No. 5,160,925.

The stabilizer may be configured to a pulser only instead of to the complete MWD system. In this case, stabilizer position measurements may be encoded into a format which will not interfere with the concurrent MWD pulse transmission. In this encoding format, the duration of pulses is timed instead of the spacing of pulses. Spaced pulses transmitted concurrently by the MWD system may still be interpreted correctly at the surface because of the gradual increase and long duration of the stabilizer pulses. An example of such an encoding scheme is shown in FIG. 9.

The position of the stabilizer blades will be transmitted with the directional survey when the stabilizer is run tied-in with MWD. When not connected to a complete MWD system, the pulser or controllable flow restrictor may be integrated into the stabilizer, which will still be capable of transmitting position values as a function of pressure and time, so that positions can be uniquely identified.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A drilling system for a bottomhole assembly, comprising:

a drill bit;

a first stabilizer positioned near said drill bit, said first stabilizer having a generally tubular configuration with a particular cross-sectional diameter;

a second stabilizer positioned in the bottom hole assembly a predetermined distance above said first stabilizer, said second stabilizer having a generally tubular configuration with a particular cross-sectional diameter, wherein the diameter of at least one of said first or second stabilizers is adjustable, between a retracted position and a plurality of extended positions, in response to a position control signal;

sensors for determining formation properties and for generating signals indicative thereof;

a microcontroller receiving the signals from said sensors, said microcontroller being located in said bottomhole assembly and being preprogrammed to respond to the signals from said sensor;

said microcontroller generating the position control signal when the sensed formation properties are outside a predetermined range;

wherein said position control signal from said microcontroller is used to adjust the diameter of the first or second stabilizer to alter the inclination angle at which said drill bit is drilling.

2. A system as in claim 1, wherein the diameter of said first stabilizer is adjustable between the retracted position and the plurality of extended positions.

3. A system as in claim 1, wherein the diameter of said second stabilizer is adjustable between the retracted position and the plurality of extended positions.

4. A system as in claim 3, further comprising a downhole motor positioned between said first stabilizer and said second stabilizer.

5. A closed loop drilling system for providing inclination control to a bottomhole assembly, comprising:

a drill bit;

a first stabilizer positioned in said bottomhole assembly near said drill bit;

a second stabilizer positioned in said bottomhole assembly a predetermined distance above said first stabilizer, wherein both the first stabilizer and the second stabilizer have an effective cross-sectional diameter, and wherein the diameter of at least one of said first or second stabilizers is adjusted to control the inclination at which the bottomhole assembly drills, and includes:

a plurality of stabilizer blades that are adjustable between a retracted position and an extended position to change the effective diameter of the stabilizer;

means for positioning said plurality of stabilizer blades;

means for controlling the operation of said closed loop drilling system, said means for controlling located in said bottomhole assembly and being programmed to drill at a desired inclination, and including means for measuring the actual inclination of the bottomhole assembly and producing an electrical output signal indicative of the actual inclination;

said means for controlling also including means for comparing the electrical output signal indicative of actual inclination with the desired inclination;

said comparing means generating a position control signal that is transmitted to said positioning means to set the diameter of said stabilizer blades.

6. A system as in claim 5, wherein said means for positioning includes:

means for driving the blades outwardly; and means for limiting the outward expansion of said blades.

7. A system as in claim 6, wherein said positioning means receives said control signal and adjusts the means for limiting to limit the outward expansion of said blades.

8. A system as in claim 5, wherein said first stabilizer is adjustable and includes a plurality of stabilizer blades that adjust between a fully retracted position and a plurality of extended positions.

9. A system as in claim 5, wherein said second stabilizer is adjustable and includes a plurality of stabilizer blades that adjust between a fully retracted position and a plurality of extended positions.

10. A system as in claim 9, further comprising a downhole motor positioned between said first stabilizer and said second stabilizer.

11. An automatic drilling system, comprising:

a drill bit located at the end of a drill string;

a stabilizer positioned in the drill string above said drill bit;

sensors for sensing parameters downhole and generating a signal indicative thereof, said sensor being located in said drill string; and means for transmitting said signal indicative of said sensed parameters;

a controller for receiving the signal from said transmitting means and for comparing said signal indicative of downhole parameters with predetermined data reflecting desired parameters, and generating a position control signal if the desired parameters differ from the sensed parameters;

wherein said stabilizer is adjustable and comprises:

a generally tubular housing with a plurality of openings;

a plurality of blades, each blade movably mounted within a respective opening to extend from a first retracted position to a plurality of positions extending at different radial distances from said housing; and positioning means for setting the radial extent of said blades, and wherein said positioning means receives said control signal from said control means and varies the position of the blades to change the inclination angle at which the drilling system drills.

12. A system as in claim 11 further comprising a near bit stabilizer positioned in the drill string between said adjustable stabilizer and said drill bit.

13. A system as in claim 12, wherein the near bit stabilizer has a diameter that also is adjustable.

14. A system as in claim 12, further comprising a drill collar between said near bit stabilizer and said adjustable stabilizer, and wherein the drilling system operates in a rotary mode.

15. A system as in claim 12, wherein said near bit stabilizer comprises an azimuth control device.

16. A system as in claim 11 further comprising a second stabilizer positioned in the drill string a predetermined distance above said adjustable stabilizer.

17. A system as in claim 16, wherein the second stabilizer has a diameter that also is adjustable.

18. A system as in claim 14, wherein at least one of the sensors is located in said drill collar.

19. A method for automatically controlling the direction in which a bottomhole assembly drills, said bottomhole assembly including a stabilizer with blades that adjust between a retracted position and a plurality of extended positions, comprising the steps of:

(a) setting the position of the blades of said stabilizer to a particular diameter;

(b) operating a drill bit to drill into a downhole formation;

(c) measuring the actual inclination of the bottomhole assembly;

(d) comparing, in a downhole controller, the actual inclination with a planned inclination;

(e) generating in the downhole controller a position control signal if the actual inclination deviates significantly from planned inclination; and (f) altering the position of the blades in response to said position control signal to provide a real-time change to the inclination of said bottomhole assembly.

20. A method as in claim 19, wherein the signal generated in step (e) indicates whether inclination is too high.

21. A method as in claim 20, wherein the position of the blades in step (f) is expanded.

22. A method as in claim 19, wherein the signal generated in step (e) indicates whether inclination is too low.

23. A method as in claim 22, wherein the position of the blades in step (f) is retracted.

24. A method for automatically controlling the inclination at which a bottomhole assembly drills a formation, said bottomhole assembly including a stabilizer with blades that adjust between a retracted position and a plurality of extended positions, comprising the steps of:

(a) setting the position of the blades;

(b) rotating a drill bit to drill into the downhole formation;

(c) determining the characteristics of the formation in which the bottomhole assembly is drilled;

(d) comparing the characteristics of the formation being drilled with a range of predetermined characteristics for a desired formation;

(e) generating a control signal if the characteristics of the formation being drilled are outside the range of the predetermined characteristics; and (f) altering the position of the blades in response to said control signal to change the inclination at which the bottomhole assembly drills.

25. A method as in claim 24, wherein the range of predetermined characteristics are set before the bottomhole assembly begins drilling.

26. A method as in claim 24, wherein the range of predetermined characteristics are communicated from the surface to the bottom hole assembly through a telemetry means after a desired formation has been entered by the bottomhole assembly.

* * * * *

UNITED STATES PATENT AND TRADEMARK OFFICE

CERTIFICATE OF CORRECTION

PATENT NO. : 5,332,048

DATED : July 26, 1994

INVENTOR(S) : Lance D. Underwood, et al

It is certified that error appears in the above—identified patent and that said Letters Patent is hereby corrected as shown below:

Column 1, line 19, before "33,751" insert —Re.—.

Signed and Sealed this

Sixteenth Day of May, 1995

*Attest:*

Bruce Lehman

BRUCE LEHMAN

*Attesting Officer*

*Commissioner of Patents and Trademarks*